US005375765A

United States Patent [19]

King

[11] Patent Number: 5,375,765

[45] Date of Patent: Dec. 27, 1994

[54] NOZZLE DEVICE FOR SUPPLYING LUBRICANT TO CONVEYORS

[75] Inventor: William J. King, Orange, Calif.

[73] Assignee: Pure-Chem Products Company, Inc., Stanton, Calif.

[21] Appl. No.: 137,632

[22] Filed: Oct. 15, 1993

[51] Int. Cl.[5] ..... B05B 15/02; B05B 1/32

[52] U.S. Cl. ..... 239/107; 239/459

[58] Field of Search ..... 239/107, 109, 460, 456, 239/436, 437, 446, 443, 451–454

[56] References Cited

U.S. PATENT DOCUMENTS 5,115,978 5/1992 King et al. ..... 239/107
5,163,618 11/1992 Cordua ..... 239/107
5,215,254 6/1993 Haruch ..... 239/107
5,232,156 8/1993 Csordas ..... 239/460 X

FOREIGN PATENT DOCUMENTS 1513736 11/1975 United Kingdom ..... 239/107

*Primary Examiner*—Andres Kashnikow
*Assistant Examiner*—Kevin P. Weldon
*Attorney, Agent, or Firm*—Willie Krawitz

[57] ABSTRACT

A nozzle for supplying lubricants to conveyors comprises a plastic housing for a spring loaded valve which can be adjusted to produce either a fan stream or a needle point stream with a minor adjustment of the valve. Contaminating material can be removed from the device by a purge tool which interfits with the valve, and the tool can easily be hand manipulated to lift the valve against the spring loading and effect purging.

14 Claims, 2 Drawing Sheets

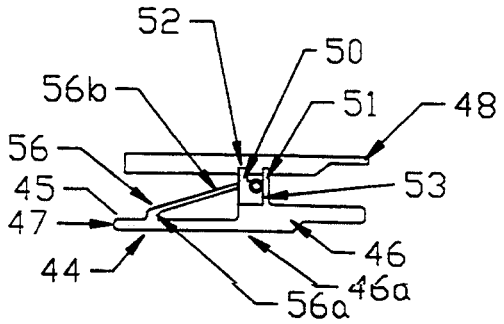
FIG. 6
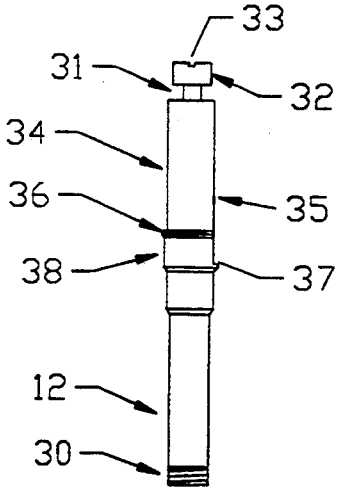
FIG. 3
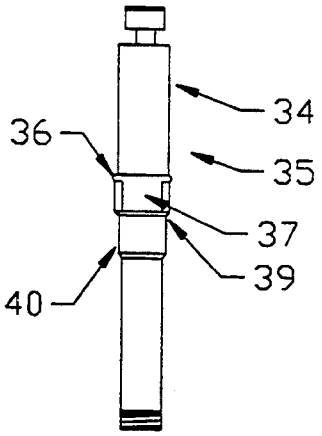
FIG. 4
FIG. 5
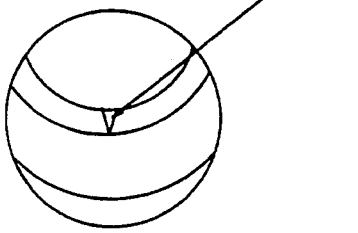
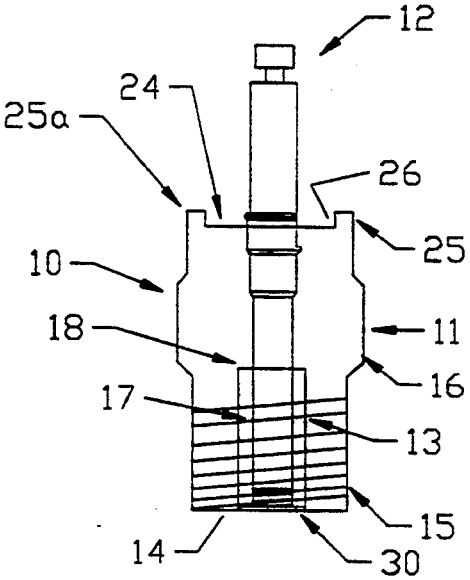
FIG. 1
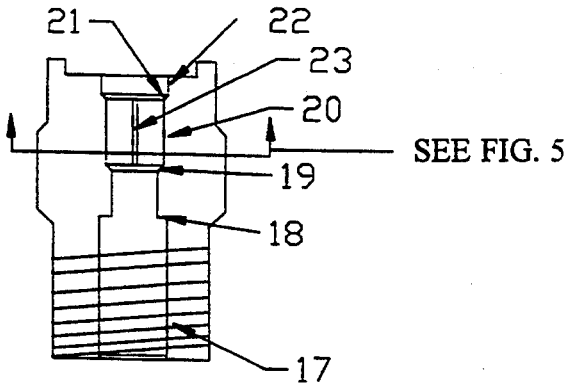
FIG. 2

NOZZLE DEVICE FOR SUPPLYING LUBRICANT TO CONVEYORS

BACKGROUND OF THE INVENTION

This invention relates to a new and improved nozzle device for supplying lubricants to conveyors, and typically in conjunction with conveyors to move containers in the soft drink industries, in dairies, in breweries, for food containers, for packaging, etc.

Conveyor lines used in the food container and packaging industry are frequently very long, perhaps several hundreds of feet, and these lines must be lubricated, since an insufficiently lubricated line will pose a danger to personnel if it breaks. Additionally, conveyor lines must be cleaned and sanitized to reduce or remove bacteria, fungus growth, algae, etc. The tendency is to over lubricate the conveyors, but this in turn is costly both in terms of lubricant use and also because the use of excessive lubricant can attract penalty sewage charges. In addition, dangers to personnel are ever present due to slippery conditions caused by the presence of large amounts of lubricant on the working floor.

Spray nozzles have been developed to supply lubricants to conveyors of the above type, but have been deficient since they are difficult to repair, clean and adjust due to their design, and since they may be mounted in inaccessible locations. To improve the ease of adjustment, repair, and cleaning these nozzles, the inventor herein developed a nozzle described in U.S. Pat. Nos. 5,033,676 and 5,1215,978.

Cleaning of the nozzle described in the patents can be accomplished by means of unseating the nozzle valve either by increasing the inlet pressure of the lubricant solution, or by retracting the nozzle valve with a tool, but in both cases this can be inconvenient.

In addition, while the nozzle described in the patents can be operated to produce a fan spray or to produce a needle point stream, this requires adjustment of a deflector screw, and this type of adjustment tends to be a time consuming task.

The present invention enables purge cleaning of the nozzle by means of a tool to unseat the valve, and which is more convenient to manipulate by hand. Also the purge cleaning takes less time, does not require a change in the inlet pressure of the lubricant solution, and the purging operation can be carried out simultaneously while the lubricant solution is being supplied to the conveyor line. In addition, the nozzle of the present invention is designed to operate in two modes, one mode producing a fan stream, and the other mode producing a needle point stream, the device being quickly adjustable to either mode.

THE INVENTION

According to the invention, a nozzle device is provided to supply lubricant solution to a conveyor line, comprising a housing element, and an adjustable, spring biased valve stem positioned within and for longitudinal movement along the housing element. The valve stem is configured to define a deflector having a circularly shaped shoulder to produce a fan stream, and the shoulder also has a flat portion which will form a needle point stream.

The housing element defines a fine groove on the interior wall, and when the valve stem is adjusted to orient the groove adjacent the circular portion of the deflector, a fan shaped outlet stream is produced. When the flat portion of the deflector of the valve stem is oriented to be adjacent the groove, a needle point stream is produced.

The exterior end of the valve stem defines an exterior notch to engage a purge tool, and a turning slot is provided to orient the valve stem in relation to the interior groove of the housing, thereby producing either a fan shaped outlet stream or a needle point stream.

To operate the device in a purge mode, the purge tool is engaged with the exterior notch and compressed, thereby causing the valve stem to be elevated against the spring biasing and slightly unseat from the housing. This permits the lubricant solution to flush out contaminants from the interior of the housing and from around the valve stem.

The nozzle device of this invention is operable within a pressure range up to about 1,000 psi, and at flow rates ranging from about ¼ gallons/hour to about 5 gallons/-hour @ 20 psi, and these pressure ranges are adjustable by means of the spring biasing of the valve stem.

BRIEF DESCRIPTION OF THE DRAWINGS

FIG. 1 is a side elevation view in axial section showing the housing element with the internal spring bias element and associated valve stem;

FIG. 2 is a side elevation view in axial section showing the housing element with the internal spring, the valve stem being removed;

FIG. 3 is an external side elevation axial view of the valve stem, showing the circular portion of the valve stem deflector;

FIG. 4 is an external side elevation axial view showing the flat portion of the valve stem deflector;

FIG. 5 is an enlarged, end view of the housing taken along lines 5—5 of FIG. 1, showing the internal groove of the housing;

FIG. 6 is an external view in side elevation view showing the tool adapted for lifting the valve stem out of the housing to effect purging action;

DESCRIPTION OF THE PREFERRED EMBODIMENTS

Figure 7:
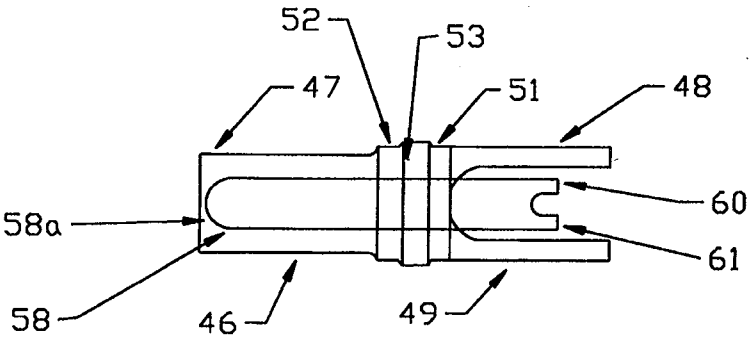
FIG. 7 is a plan view of the tool shown in FIG. 6.

The nozzle device 10 for supplying lubricant to conveyors is shown in FIG. 1, and comprises an injection molded plastic housing 11, suitable plastic materials of which include polyester, polyethylene, polypropylene, nylon, PVC, and so forth. An interfitting valve stem 12 is secured within the housing against axial and rotational movement by a spring 13 and adjustable retaining nut 14.

The housing 11 defines exterior grooves 15 at one end to enable attachment of the device to a lubricant supply line (not shown); hexagonal sides 16 are defined medially of the housing for engagement with a wrench.

The interior of the housing defines a bore 17 terminating in a shoulder 18 against which the spring 13 is pressured. The bore 17 becomes narrowed and is then chamfered outwardly 19 to define a connecting parallel bore 20, an outwardly chamfered portion 21, and a parallel bore portion 22 which provides a shoulder seat.

This bore configuration imparts a venturi action (particularly during purging) on the lubricant when it passes through the housing. The parallel bore 22 also functions to interfit, seat and form a seal with the valve stem 12, and this will be described, infra.

As shown in FIGS. 2 and 5, a fine lubricant passage groove 23 (about 0.04 cm. in depth) is defined on the bore 20, and lubricant will pass along the groove 23 for eventual application to a conveyor. A recessed, flat area 24 is formed at the housing end where the bore 17 terminates, and a circular shoulder 25 surrounds the flat area 24. A space 26 separates the top 25*a* of shoulder 25 from the flat area 24.

The valve stem 12 is constructed typically of a steel such as a 304 stainless, and one end of the valve stem is threaded 30 for adjustable securement with retaining nut 14; Use of the retaining nut also enables the compression of the spring 13 to be adjusted. The other end of the valve stem 12 defines an engaging notch 31 which terminates in a screw end 32 having a slot 33 for use with an adjusting screwdriver. The valve stem is milled to define a cylindrical spacer 34 commencing from engaging notch 31.

A deflector 35 which extends outwardly from the valve stem at the end of the spacer 14 is provided to produce either a fan spray of lubricant or a needle shaped spray, depending on the orientation of the deflector with respect to the groove 23 of the housing. The deflector 35 defines a curved portion 36 which produces the fan spray and a flat portion 37 is defined to form a needle shaped spray of lubricant.

The deflector 35 terminates at the bottom of the curved portion 36 to form a hub area 38 which enters into and forms a seal along the housing bore 22. A shoulder 39 is defined at the bottom of the notch 38 and seats on top of the chamfered portion 21 of the bore 22, thus preventing the valve stem 12 from moving any further along bore 17 of the housing.

A hub portion 40 is defined adjacent the shoulder 39 and is designed to additionally interfit and seal the valve along the parallel shaped portion 20 of the housing bore 17. Along with pressure produced by the spring loading, the interfit and seal of the valve stem along bores 20 and 22 of the housing will prevent leakage of lubricant around the housing, except for passage of lubricant along the groove 23. By contrast, many prior art nozzles need a sealing ring to effect sealing.

The tool 44 used to enable purging of the device 10 is shown in FIGS. 6–9, and comprises a plastic body portion 45 having a base portion 46, and bottom side 46*a*, the base portion extending from its free end 47 into lower fork-shaped prongs 48, 49. An upper hub portion 50 defines forward and rearward retaining walls 51, 52 and a round slot 53 between the two walls. The forward wall defines a shallow slot 54, and the rearward wall defines a deeper slot 55, the latter two slots being oriented transversely to slot 53.

An upwardly flexible biasing arm 56 is integrally formed with the tool 44, the fulcrum end 56*a* of the biasing arm being attached to the base portion 46; the free end 56*b* of the fulcrum is positioned just within slot 55.

A stainless steel elevating arm 58 having a free end 58*a* is welded to a transverse fulcrum 59, and the fulcrum 59 is press fitted within the round slot 53. The elevating arm 58 moves about the fulcrum 59 and within the slot 55.

Engaging prongs 60 and 61 are provided at the end of the elevating arm 58 and overlay the fork-shaped prongs 48 and 49 of the base portion 46, as shown in FIG. 7. Prior to use, the biasing arm 56 will bear against the underside of the arm 58 and tilt it slightly so that the elevating arm is about parallel to the base portion 46; this enables the elevating arm to be oriented horizontally and easily interfit with the valve stem.

Figure 9:
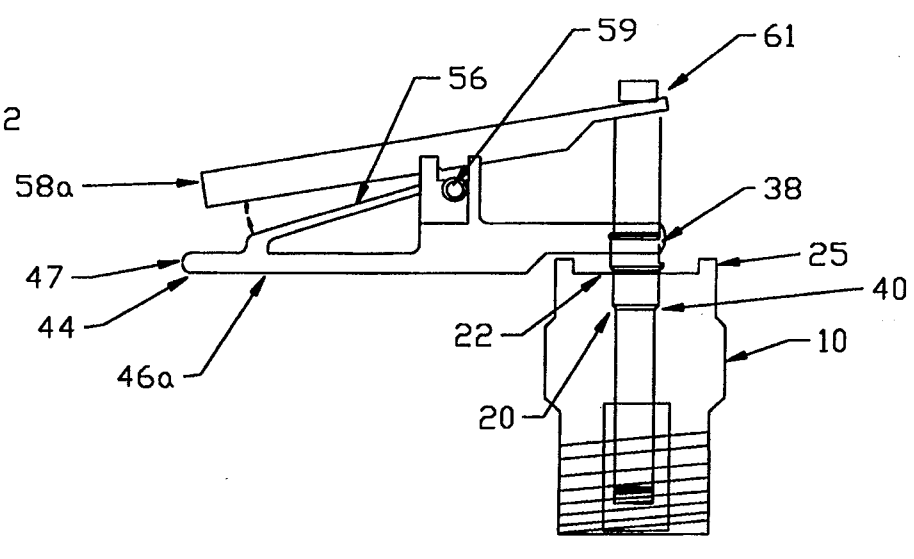
Figure 8:
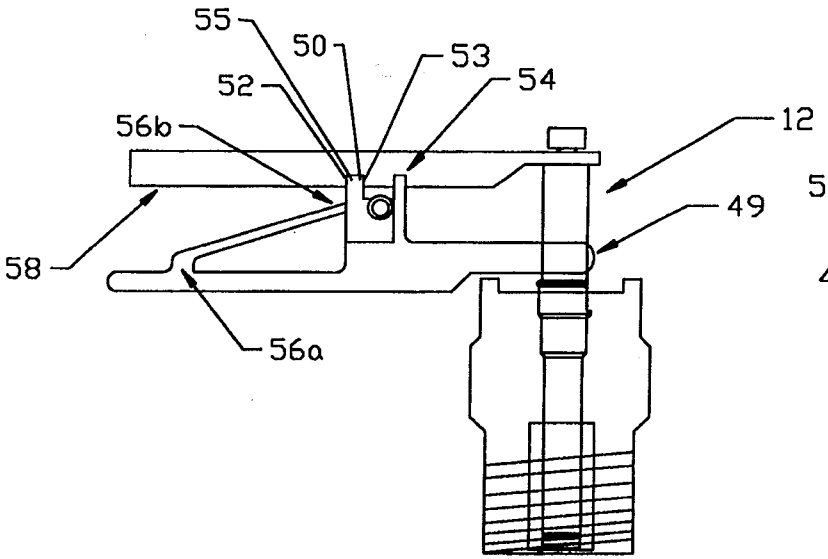
FIG. 8 is an external, side elevation view of the tool shown in FIG. 6 interfitting with the housing and valve stem of FIG. 1; and, FIG. 9 is an external, side elevation view of the tool, and similar to FIG. 8, the tool being shown lifting the valve stem to effect purging action of the device.

As shown in FIGS. 8 and 9, when the tool 44 is used to engage the valve stem 12 to elevate and slightly unseat the valve stem from the housing, the engaging prongs 60 and 61 of the elevating arm 58 are interfitted with engaging notch 31 of the valve stem. At the same time, the fork-shaped prongs 48 and 49 of the base portion 46 are superposed over the circular shoulder 25, along the bottom 46*a* of base portion 46.

As shown in FIG. 9, the valve stem 12 is then elevated slightly out of the housing simply by pressing together the end 47 of the base portion 46 and the free end 58*a* of the elevating arm 58.

The operation of the tool 44 will elevate valve stem 12 a short distance against the spring loading and slightly unseat the valve from the housing. The pressure of the lubricating fluid will then flush out contaminants from the housing and from around the valve stem. When the purging operation is completed, the elevating tool 44 is removed, and the spring loading will retract the valve stem back into position in the housing, without requiring manual adjustment.

It will be appreciated that the device can be operated in a fan spray mode simply by orienting the curved portion 36 of the deflector 35 so that it is adjacent the groove 23 of the housing. To operate the device in a needle point stream mode, the flat portion 37 of the deflector is oriented to be adjacent the groove 23. Both modes of operation are achieved simply by turning the device with a screw driver against the spring loading, using the slot 33 of the screw end 32.

The device of this invention requires few component parts which are inexpensive, and the device can be easily serviced for purging purposes, or dismantled if necessary, and can be easily adjusted to produce either a fan spray or a needle point spray. The simplicity of the device enables it to be used with little training, and since it does not require any great skills for its use, the device can be easily serviced on an emergency basis by most plant personnel who happen to be in the vicinity. Moreover, purging the device does not require an increase in lubricant pressure and its attendant inconvenience with ongoing plant operations.

Moreover, the nozzle device of this invention enables far less use of lubricant to be applied to the conveyor, and this results in less costs, provides a more favorable working environment, and reduces sewage charges for excess use.

It will be appreciated that many equivalent variations of this invention can be employed without departing from the spirit thereof. For example, instead of using a plastic housing and a metal valve stem to effect sealing, without employing a sealing ring, a metal housing and plastic valve can be employed to accomplish the same purpose. Similarly, other types of surface configurations on the valve stem may be provided to interlock with a purge tool.

Also, the valve stem may be configured in various shapes for impingement with lubricant from the nozzle to produce a fan spray or a needle point spray (e.g., curved, rather than flat shaped). In addition, the groove 23 defined along the interior housing may instead be replaced, or supplanted by a similar groove formed on the valve stem itself. Moreover, if desired, additional grooves may be employed along the housing side wall or the valve exterior.

I claim:

1. A nozzle device for supplying lubricant to a conveyor from a lubricant supply source, comprising:

a.) a housing providing a bore portion defining an interior wall which is configured to define two sealing surfaces thereon; and, b.) a valve stem mounted for movement within the bore portion of the housing and secured therein by a spring loading; a lubricant supply groove defined between the valve stem and the housing for passage of lubricant therethrough; the valve stem being configured to define corresponding surfaces for seating and sealing along the two sealing surfaces of the housing; the valve stem providing securing means for the spring loading; and, means to engage a lifting device; a deflector portion defining a curved contact surface for impingement with lubricant from the nozzle to produce a fan spray, and a flat contact surface parallel to the groove for impingement with lubricant from the nozzle to produce a needle point spray for application to a moving conveyor, the lubricant being supplied to the conveyor through the groove; the valve stem being seated and sealed within the housing in a closed position; the valve stem providing engaging means for an adjusting tool to rotate the valve stem for orientation of the deflector towards the groove for producing a fan spray or a needle point spray; and, means for unseating the valve stem from the housing by means of an engaging lifting device and against the spring loading, to remove the valve stem from sealing contact with the sealing surface of the bore portion of the housing, thereby enabling contaminants to be purged from the housing and the valve stem by means of pressurized lubricant, without requiring removal of the nozzle device from the lubricant supply source; and, after removal of contaminants from the valve stem and housing, and following disengagement from the lifting device, the valve stem is retractable by the spring loading, for reseating and resealing within the housing.

2. The nozzle device of claim 1, comprising adjustable spring loading means.

3. The nozzle device of claim 1, including conveyor means for applying lubricant thereto from the nozzle device.

4. The nozzle device of claim 1, in which the lifting device is adapted to engage and vertically dislodge the valve stem from the housing, thereby unseating and unsealing the valve stem from contact with the housing, and when the valve stem is disengaged from the lifting device, the valve stem is adapted to vertically reseat and reseal with the housing.

5. The nozzle device of claim 1, adapted to deliver lubricant solution up to about 1,000 psi.

6. The nozzle device of claim 1, adapted to deliver lubricant solution up to about 1,000 psi, and from about $\frac{1}{4}$ gallons/hr. to about 5 gallons/hr. at 20 psi.

7. The nozzle device of claim 1, in which the housing is plastic and the valve stem is stainless steel.

8. The nozzle device of claim 7, in which the groove is defined along the housing bore.

9. The nozzle device of claim 1, in which the groove is about 0.04 cm. in depth.

10. The nozzle device of claim 1, in which the deflector defines a curved contact area for producing a fan spray of lubricant, and a flat contact area for producing a needle point spray of lubricant.

11. The nozzle device of claim 1, in which the housing is threaded for attachment to a lubricant supply line.

12. The nozzle device of claim 1, in which the housing bore defines a venturi shape.

13. The nozzle device of claim 1, in which the valve stem is end slotted for rotational engagement with the adjusting tool.

14. The nozzle device of claim 1, including a lifting device, the valve stem defining an end notch for engagement with the lifting device, which includes inwardly compressible arms comprises a rotatable fork member which engages the end notch of the valve stem, the lifting device upon manual compression of the arms being adapted to vertically unseat and unseal the valve stem from the housing and against the spring loading, thereby enabling the device to be purged with lubricant, and upon retraction of the lifting device from the valve stem, to permit the valve stem to vertically reenter, reseat and reseal with the housing.

* * * * *